United States Patent [19]

Miller

[11] Patent Number: 4,529,013

[45] **Date of Patent: * Jul. 16, 1985**

[54] PAPERMAKERS FABRICS

[75] Inventor: Terence Miller, Chorley, England

[73] Assignee: Scapa-Porritt Limited, Blackburn, England

[ * ] Notice: The portion of the term of this patent subsequent to Sep. 15, 1998 has been disclaimed.

[21] Appl. No.: 290,007

[22] Filed: Aug. 4, 1981

Related U.S. Application Data

[63] Continuation of Ser. No. 109,661, Jan. 21, 1980, Pat. No. 4,289,173, which is a continuation of Ser. No. 871,460, Jan. 23, 1978, abandoned, which is a continuation of Ser. No. 735,986, Oct. 27, 1976, abandoned.

[30] Foreign Application Priority Data

Oct. 30, 1975 [GB] United Kingdom ..... 44800/75

[51] Int. Cl.[3] ..... D03D 15/00; D21F 1/10

[52] U.S. Cl. ..... 139/383 A; 139/420 R; 139/425 A; 162/DIG. 1

[58] Field of Search ..... 139/420 R, 425 A, 383 A, 139/383 R, 408–415, 420, 420 A, 425 R; 162/DIG. 1, 348, 358; 245/2, 8

[56] References Cited

U.S. PATENT DOCUMENTS

| | | | |
|---|---|---|---|
| 2,903,021 | 9/1959 | Holden et al. | 139/383 A |
| 2,949,134 | 8/1960 | Hindle et al. | 139/383 A |
| 3,000,771 | 9/1961 | Runton | 139/408 |
| 3,207,659 | 6/1965 | Wagner | 139/425 A |
| 3,216,893 | 11/1965 | Schuster . | |
| 3,256,142 | 6/1966 | Devine | 162/DIG. 1 |
| 3,279,504 | 10/1966 | Wagner | 139/383 A |
| 3,473,576 | 10/1969 | Amneus | 139/425 A |
| 3,523,867 | 8/1970 | MacBean . | |
| 3,603,354 | 9/1971 | Lee . | |
| 3,745,066 | 7/1973 | Bleuer | 139/420 R |
| 3,858,623 | 1/1975 | Lefkowitz | 139/425 A |
| 3,915,202 | 10/1975 | Curtis et al. | 139/425 A |
| 4,149,571 | 4/1979 | Burroughs | 139/420 R |

FOREIGN PATENT DOCUMENTS

| | | | |
|---|---|---|---|
| 242399 | 12/1962 | Australia . | |
| 421922 | 2/1972 | Australia . | |
| 725519 | 5/1969 | Belgium . | |
| 630975 | 11/1961 | Canada | 139/425 A |
| 1557944 | 1/1969 | France . | |
| 173282 | 2/1974 | New Zealand . | |
| 325094 | 12/1957 | Switzerland . | |
| 810603 | 3/1959 | United Kingdom . | |
| 863508 | 3/1961 | United Kingdom . | |
| 931804 | 7/1963 | United Kingdom . | |
| 985451 | 3/1965 | United Kingdom . | |
| 990730 | 4/1965 | United Kingdom . | |
| 1002095 | 8/1965 | United Kingdom . | |
| 804151 | 11/1968 | United Kingdom . | |
| 1220531 | 1/1971 | United Kingdom . | |
| 1290781 | 9/1972 | United Kingdom . | |
| 1327444 | 8/1973 | United Kingdom . | |

OTHER PUBLICATIONS

"Sieband Filz", by Karl Keim, pp. 42 and 51.

*Primary Examiner*—James Kee Chi
*Attorney, Agent, or Firm*—Fleit, Jacobson, Cohn & Price

[57] ABSTRACT

The warp and/or the weft of a woven papermakers fabric is made from a combination of polyester monofilament yarns and separate yarns of a different material preferably a more wear-resistant material so that the polyester yarns give adequate dimensional stability while the other yarns impart a different property, preferably, improved wear resistance.

16 Claims, 2 Drawing Figures

PAPERMAKERS FABRICS

This is a continuation of application Ser. No. 109,661 filed Jan. 21, 1980 now U.S. Pat. No. 4,289,173, which, in turn, is a continuation of Ser. No. 871,460, filed Jan. 23, 1978 now abandoned, which, in turn, is a continuation of Ser. No. 735,986, filed Oct. 27, 1976, now abandoned.

In a papermaking machine, a moisture or water laden web of cellulosic fibres is flowed onto a traveling wet end or forming fabric, generally a woven belt of wire and/or synthetic material, to form a continuous sheet of paper or paper-like materal.

As the web travels along on the forming fabric, much of its water content is removed by draining and a somewhat self-supporting continuous web is formed. This water removal is enhanced by the use of such well-known devices as hydrofoils, table rolls, and/or suction boxes.

After leaving the wet end or forming section at a couch roll, the somewhat self-supporting web is transferred to a press section in the machine where still more of its water content is removed by passing it through a series of pressure nips formed by cooperating press rolls, these press rolls also serving to compact the web. The paper web is then transferred to a dryer felt in a dryer end or dryer section of the machine where it is passed about and held in heat transfer relationship with a series of heated, cylindrical rolls by which still further amounts of water are removed by evaporation. Optionally, the paper web then is passed through a series of calendar rolls where loose fiber ends are laid down and the paper web is provided with a smooth finish. Finally, the paper web is collected on a suitable reel.

The invention concerns papermakers fabrics, and has more particular reference to what are known in the art as "wet end" fabrics, that is to say drainage fabrics, such as fourdrinier wires, intended to support a moisture laden web of cellulosic fibres.

Originally fourdrinier wires comprised structures woven from metal wires, the preferred material of choice being phosphor bronze.

In recent years synthetic yarns have been widely used in the production of papermakers fabrics, including drainage fabrics for the wet end of the papermaking machine, but the inherent characteristics of the synthetic yarns in the context in question has given rise to some difficulties. Thus, in the case of polyester yarns, there is the problem of wear, whilst in the case of polyamides, there is the difficulty of dimensional instability on account of moisture take-up.

In our co-pending British Patent Application No. 44799/755 we have described the use of a coating to improve the wear resistance of a wet end fabric formed from polyester yarns.

It has previously been proposed to overcome the problem of dimensional instability of polyamide yarns, and render such yarns suitable for application in the context of wet end fabrics by applying a resin coating to a multifilament yarn, the polyamide being totally unacceptable in its untreated state.

The object of the present invention is to provide a wet end fabric of adequate wear resistance and dimensional stability without the need to apply a coating for such purposes.

DESCRIPTION OF THE DRAWINGS

The accompanying drawings.

FIG. 1 shows a woven single layer fabric having machine direction yarns 1 and cross-machine direction yarns 2 and 3. The machine direction yarns 1 are polyester monofilament yarns. The cross-machine direction yarns 2, 3, which lie in and define substantially the same plane, consist of alternate polyester monofilament yarns 2 and polyamide monofilament yarns 3 arranged adjacently throughout the fabric.

FIG. 2 shows a woven fabric having machine direction yarns 6 and two layers of cross machine direction yarns 4 and 5. The machine direction yarns 6 are polyester monofilament yarns. The cross machine direction yarns 4 of one layer are polyester monofilament yarns and the cross machine direction yarns 5 of the other layer are polyamide monofilament yarns.

Figure 1:
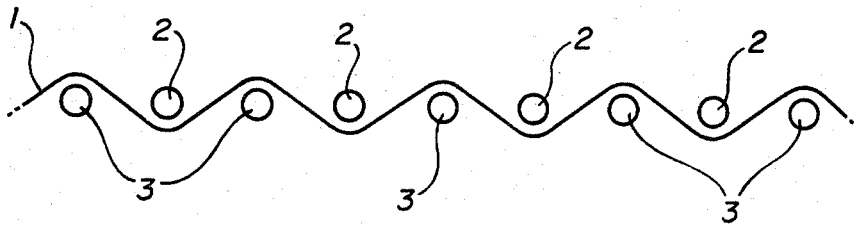
FIGS. 1 and 2, illustrate, by way of example, two embodiments of the invention.
Figure 2:
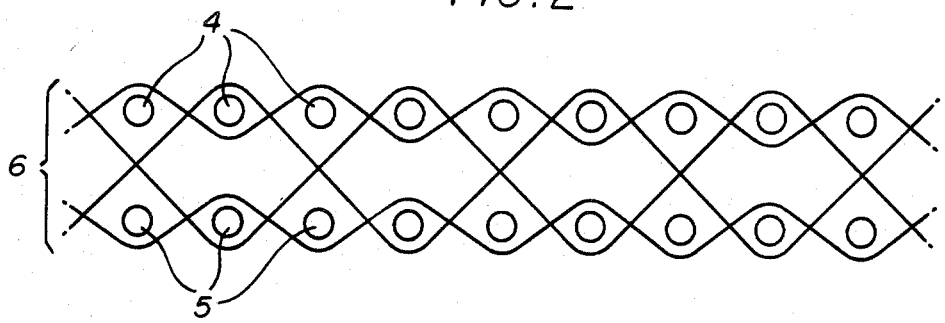

Thus, according to the present invention, we propose a papermakers fabric, particularly a wet end fabric, which is a woven structure having polyester yarns in at least one of the machine and cross-machine directions so as to impart dimensional stability in at least the or each direction in which such yarns extend, characterised in that said woven structure also includes further yarns formed from a different material from, and extending in a common direction to the first said yarns.

Preferably, the further yarns are more wear resistant than the first said yarns and with this arrangement it has been found possible to achieve, unexpectedly, improved wear resistance whilst maintaining dimensional stability without requiring the yarns to be coated.

The inherent dimensional stability of the polyester yarns is not, as might be expected, offset by any instability of the other yarns.

Preferably, the said further yarns constitute no more than 50% of the yarns in the or each direction in which they extend, the remaining yarns in such direction all being the first said yarns, and in particular 50% of the yarns may be the further yarns.

In a particularly preferred embodiment the said further yarns are interposed between the first said yarns, and the said further yarns and the first said yarns may be arranged alternately.

Alternatively, or additionally the fabric may have at least two layers of common direction yarns comprising an upper layer of the first said yarns and a lower layer of the said further yarns or vice versa. In particular, the upper layer may be formed wholly of the first said yarns and the lower layer wholly of the further yarns.

The first said yarns are dimensionally stable polyester yarns such as are conventionally used in papermakers fabrics, that is yarns formed from polyester of the polyethylene teraphthalate kind as sold for example under the Trade Mark TERYLENE or TREVIRA.

The further yarns may be any suitable material such as polyamide, polyolefin, polytetrafluoroethylene, or even a polyester (such as polybutyl teraphthalate) having the requisite properties. A polyamide, particularly a polyamide as sold under the Trade Mark Nylon, is preferred.

Comparative tests between a standard fabric woven wholly from monofilament polyester yarns and an equivalent fabric woven partly from polyester (Terylene) and partly from polyamide yarns (Nylon 6), in accordance with one example embodiment of the present invention show the increase in wear resistance to be significant, and so much so that either an equivalent fabric of corresponding drainage characteristics can be provided which has an improved service life, or alternatively a finer fabric of improved drainage characteristic and a like service life can be produced.

In carrying out the tests, the following procedure was adopted:

A sample forming fabric was held, under tension, in contact with the upper part of the periphery of a disc rotating in a vertical plane, whilst a slurry of a material commonly used in the papermaking art and having abrasive characteristics was continuously applied to the outer surface of the fabric.

The thickness of the sample was measured initially, and again after a predetermined time. The disc was rotated at the same speed, the tension applied to the sample remained constant and the slurry was applied at a constant rate throughout the tests.

The control sample comprises a woven fabric having monofilament yarns both in machine direction and cross-machine direction, there being 26 machine direction ends and 20 cross-machine direction yarns of monofilament polyester yarns of 0.25 mm diameter per centimeter, whilst in the polyester/polyamide sample the cross-machine direction yarns comprised alternate polyester and polyamide monofilament yarns, the weave structure in the two samples being the same. The abrasive material used was calcium carbonate.

The following results were obtained:

| Time in Minutes | Control Sample | Thickness in (mm) Polyester/Polyamide Sample |
|---|---|---|
| 0 | 0.55 | 0.55 |
| 40 | 0.37 | 0.46 |

The test results suggest that the wear resistance of the fabric having the polyester/polyamide cross-machine direction yarns is improved as compared with the control sample which is wholly of polyester yarns.

It is to be understood that if the machine direction yarns of the fabric are ordinarily to be expected to be subjected to the wear, then the polyester/polyamide combination will be applied to the machine direction yarns rather than to the cross-machine direction yarns.

In those instances where wear both to machine and cross-machine direction yarns is experienced a polyester/polyamide combination will be provided in both directions.

The invention is, of course, not restricted to alternate machine or cross-machine direction polyester and polyamide yarns, since other fabric structures may well be of utilisation.

Whilst one preferred arrangement has been described in which there are 50% of said further yarns, in alternative embodiments there may be a different proportion of further yarns. Thus, there may be up to 60% further yarns particularly but not necessarily in the case of a circular weave, and there may be more or less than 50% where this is desirable or necessary due to the weaving pattern used whether circular or flat woven.

What I claim is:

1. A forming fabric for supporting and draining water from a water laden web of cellulosic fibers for use in the wet end of a papermaking machine having a wet end and a dryer end, said fabric comprising:

a woven structure of machine direction and cross-machine direction yarns;

first cross-machine direction yarns formed wholly from polyester material so as to impart dimensional stability in the cross-machine direction in which such yarns extend;

said fabric also including further cross-machine direction yarns separate from and extending essentially parallel with said first cross-machine direction yarns, said further cross-machine direction yarns being formed wholly from a synthetic material different from and of greater wear resistance than said polyester material of said first yarns.

2. A fabric according to claim 1, where said further yarns constitute no more than 50% of the yarns in the cross-machine direction, the remaining yarns in said cross-machine direction all being said first yarns.

3. A fabric according to claim 1, wherein said further yarns are interposed between said first yarns.

4. A fabric according to claim 3, wherein 50% of the yarns are said further yarns and wherein said further yarns and said first yarns are arranged alternately.

5. A fabric according to claim 1, comprising at least two layers of cross-machine direction yarns comprising an upper layer of first yarns and a lower layer of said further yarns.

6. A fabric according to claim 5, wherein 50% of the yarns are said further yarns and wherein the upper layer is formed wholly of said first yarns and the lower layer is formed wholly of said further yarns.

7. A fabric according to claim 1, wherein said further yarns are polyamide yarns.

8. A fabric according to claim 1, wherein said first yarns are monofilament yarns.

9. A fabric according to claim 1, wherein said further yarns are monofilament yarns.

10. A fabric according to claim 1, wherein said further yarns are substantially out of contact with said first yarns.

11. A multi-layer papermakers wet end fabric having a web support layer and a machine element contacting layer, each layer being defined by common direction yarns, said fabric comprising: in one of said layers, a first plurality of said common direction yarns formed wholly from polyester material so as to impart dimensional stability in the direction in which said yarns extend, and, in the other of said layers, a second plurality of said common direction yarns formed wholly from a synthetic material different from and of greater wear resistance than said polyester material of said first plurality of yarns.

12. The wet end fabric of claim 11, wherein said second plurality of said common direction yarns are polyamide yarns.

13. A multi-layer papermakers wet end fabric having a web support layer and a machine element contacting layer, said fabric comprising: a first plurality of common direction yarns defining one of said layers, each of the yarns of said first plurality being formed wholly from polyester material so as to impart dimensional stability in the direction in which said yarns extend, and a second plurality of common direction yarns defining the other of said layers, and extending in the same direction as said first plurality of common direction yarns, each of the yarns of said second plurality being formed wholly from a synthetic material different from and of greater wear resistance than said polyester material of said first plurality of yarns.

14. A single layer forming fabric for supporting and draining water from a water laden web of cellulosic fibers in the wet end of a papermaking machine having a wet end and a dryer end, said fabric comprising: first cross-machine direction yarns formed wholly from polyester material so as to impart dimensional stability in the cross-machine direction in which said yarns extend, said woven structure also including further cross-machine direction yarns extending essentially parallel and lying in substantially the same plane with said first yarns, said further yarns being formed wholly from a nylon material of greater wear resistance than said polyester material of said first yarns, said first and further cross-machine direction yarns being arranged symmetrically throughout the fabric and said further yarns constituting no more than 50% of the yarns in the cross-machine direction.

15. A forming fabric for supporting and draining water from a water laden web of cellulosic fibers for use in the wet end of a papermaking machine having a wet end and a dryer end, said fabric comprising:

a woven structure of machine direction and cross-machine direction yarns;

first machine direction yarns formed wholly from polyester material so as to impart dimensional stability in the machine direction in which such yarns extend;

said fabric also including further machine direction yarns separate from and extending essentially parallel with said first machine direction yarns, said further machine direction yarns being formed wholly from a synthetic material different from and of greater wear resistance than said polyester material of said first yarns.

16. A fabric according to claim 15, further comprising at least two layers of cross-machine direction yarns comprising an upper layer of first yarns and a lower layer of said further yarns.

* * * * *